US008929752B2

(12) United States Patent
Ohta et al.

(10) Patent No.: US 8,929,752 B2
(45) Date of Patent: Jan. 6, 2015

(54) FIXING DEVICE AND IMAGE FORMING APPARATUS USING SAME

(75) Inventors: Yoshihide Ohta, Sagamihara (JP); Kazunori Bannai, Atsugi (JP); Kohta Takenaka, Yokohama (JP); Hidehiko Fujiwara, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 168 days.

(21) Appl. No.: 12/837,917

(22) Filed: Jul. 16, 2010

(65) Prior Publication Data

US 2011/0026961 A1 Feb. 3, 2011

(30) Foreign Application Priority Data

Jul. 28, 2009 (JP) ..... 2009-175213

(51) Int. Cl.
*G03G 15/20* (2006.01)
*G03G 15/00* (2006.01)

(52) U.S. Cl.
CPC ..... *G03G 15/55* (2013.01); *G03G 15/2078* (2013.01); *G03G 15/70* (2013.01)
USPC ..... 399/33; 399/69; 399/329

(58) Field of Classification Search
CPC ..... G03G 15/55; G03G 15/70
USPC ..... 399/9, 33, 38, 67, 69, 70, 122, 320, 399/328–331, 335; 219/216, 244
See application file for complete search history.

(56) References Cited

U.S. PATENT DOCUMENTS

| | | | | | |
|---|---|---|---|---|---|
| 5,465,141 | A * | 11/1995 | Asano et al. | ..... | 399/69 |
| 5,621,510 | A * | 4/1997 | Okuda et al. | ..... | 399/338 |
| 6,097,006 | A * | 8/2000 | Inukai | ..... | 219/497 |
| 2004/0197112 | A1 * | 10/2004 | Saito et al. | ..... | 399/69 |
| 2006/0157464 | A1 * | 7/2006 | Omata et al. | ..... | 219/216 |
| 2008/0131159 | A1 * | 6/2008 | Sone et al. | ..... | 399/69 |

FOREIGN PATENT DOCUMENTS

| | | | | | |
|---|---|---|---|---|---|
| JP | 2001-201978 | | 7/2001 | | |
| JP | 2001318546 | A * | 11/2001 | ..... | G03G 15/20 |
| JP | 2002-6656 | | 1/2002 | | |
| JP | 2002-311749 | | 10/2002 | | |
| JP | 2005077609 | A * | 3/2005 | ..... | G03G 15/20 |
| JP | 2007-219007 | | 8/2007 | | |
| JP | 2008197265 | A * | 8/2008 | ..... | G03G 15/20 |
| JP | 4257171 | | 2/2009 | | |

* cited by examiner

*Primary Examiner* — Benjamin Schmitt
(74) *Attorney, Agent, or Firm* — Oblon, Spivak, McClelland, Maier & Neustadt, L.L.P.

(57) ABSTRACT

A fixing device for fixing an unfixed toner image on a recording medium includes a rotatable fixing member heated by a heater to contact the recording medium bearing the unfixed toner image while rotating, with the heater disposed inside a hollow of the fixing member and turned on and off intermittently at a start of a fixing process to heat the fixing member intermittently, a first pressing member disposed opposite the fixing member to press against and rotate the fixing member to define a fixing nip through which the recording medium passes to fix the unfixed toner image with heat and pressure, and a temperature detector to detect a change in the temperature of the fixing member when the heater turns on and off intermittently. When the temperature detector detects the change in the temperature of the fixing device, the heater is turned on continuously.

23 Claims, 5 Drawing Sheets

FIXING DEVICE AND IMAGE FORMING APPARATUS USING SAME

CROSS-REFERENCE TO RELATED APPLICATIONS

This patent application is based on and claims priority pursuant to 35 U.S.C. §119 from Japanese Patent Application No. 2009-175213, filed on Jul. 28, 2009 in the Japan Patent Office, which is hereby incorporated herein by reference in its entirety.

BACKGROUND OF THE INVENTION

1. Field of the Invention

Exemplary aspects of the present invention generally relate to a fixing device and an image forming apparatus including the same, and more particularly, to a fixing device that fixes an unfixed toner image on a recording medium by applying heat and pressure thereto and an image forming apparatus including the fixing device.

2. Description of the Background Art

Typically, a fixing device for fixing an unfixed toner image onto a recording medium is equipped with a roller-type fixing member (hereinafter referred to as fixing roller), a roller-type pressure member (hereinafter referred to as pressure roller), and a halogen heater serving as a heating member. The fixing roller is generally hollow and accommodates the halogen heater inside thereof. Supplying electric power to the halogen heater heats the fixing roller. The pressure roller is pressed against the fixing roller by an urging member.

Such a fixing device is provided with a temperature detector to detect the temperature of the surface of the fixing roller. An output of the temperature detector is provided to a temperature controller that controls the halogen heater based on the output of the temperature detector, thereby maintaining the surface temperature of the fixing roller at a certain temperature.

The fixing device as described above fixes an unfixed toner image on a recording medium by applying heat and pressure to the recording medium as it passes between the fixing roller and the pressure roller, specifically, where the fixing roller and the pressure roller meet and press against each other, hereinafter called a fixing nip or simply nip.

One example of such a fixing device employed in image forming apparatuses such as copiers and printers is a so-called on-demand fixing device. A rise time of this type of fixing device is known to be short.

Various types of on-demand fixing devices have been proposed. One example of a known on-demand fixing device employs a tubular fixing film (endless film) serving as a fixing member, a pressure roller serving as a pressing member, and a heater such as a ceramic heater serving as a heating member. The heater is provided inside the tubular fixing film and pressed against an interior surface of the fixing film, thereby heating the fixing film. The fixing film contacts the pressure roller to form the nip where pressure and heat are applied to the unfixed toner image on the recording medium to fix the unfixed toner image onto the recording medium.

In order to prolong the product life of the fixing member and prevent paper jams and fixing defects such as "hot offset" in this type of fixing device, the fixing member, that is, the tubular fixing film, needs to be heated evenly and stably. "Hot-offset" herein refers to an undesirable phenomenon in which part of a fused toner image is adhered to the surface of the heating member, and is re-transferred onto the sheet itself or the following sheet of the recording material.

In view of the above, several approaches have been tried to reliably achieve a proper fixing operation. For example, in order to prevent hot-offset, Japanese Patent Application Publication No. (hereinafter "JP-A") 2002-311749 proposes to reduce a fixing temperature in accordance with a number of prints when printing in a low speed mode, and includes a temperature estimation mechanism that estimates the temperature of the pressure roller when printing in a high speed mode. In this configuration, the fixing temperature is determined according to the result and the number of prints.

By contrast, JP-2001-201978-A discloses a method of controlling the temperature of the fixing belt. Specifically, the heating roller of the fixing device includes a plurality of heat sources, that is, a first heat source having a first luminous intensity distribution (thermal distribution) substantially corresponding to the area of a sheet of paper of small size and a second heat source having a second luminous intensity distribution substantially corresponding to both ends of the heating roller that is not in the first luminous intensity distribution. Further, the fixing belt includes first and second temperature detectors for detecting temperature in the first and the second luminous intensity distributions, respectively.

In this configuration, the temperature of the fixing belt is adjusted to a specified temperature based on the temperature detected by the first and the second temperature detectors. Disadvantageously, however, using two heat sources increases the size of the fixing device and its cost, thereby complicating efforts to make the image forming apparatus as a whole as compact and low cost as is usually desired.

Although generally advantageous, such related-art on-demand fixing devices using the tubular fixing roller have a drawback in that the range of shapes of the nip is limited, which restricts ways to improve fixing ability as well as prevent curling and creasing in different kinds of recording media.

Furthermore, typically, the on-demand fixing devices employ the film-type fixing member to achieve short rise time. In order to achieve that effect, the film-type fixing member needs to be heated evenly and stably. However, in general, the fixing member is subjected to highly localized heating by the heating member. Thus, if the fixing member remains stationary and does not move, such that it is heated continuously by the heating member, the temperature of that particular portion of the fixing member being heated rises significantly, causing deformation of and damage to the fixing member.

Accordingly, in an effort to monitor the operating state of the fixing member, that is, to detect movement or rotation of the fixing member, conventionally the movement of the fixing member is detected by detecting an operation of a drive source of the fixing member or a driving force transmission device. However, in this approach, even when the driving force is not properly transmitted to the fixing member from the drive source, for example, when the fixing member slips out of rotation with the drive source, leaving the fixing member immobilized even as the driving force continues to be transmitted to the fixing member, the fixing member is erroneously detected as being rotated.

In view of the above, a small-size, low-cost, on-demand fixing device that reliably fixes an unfixed toner image for an extended period of time is required.

SUMMARY OF THE INVENTION

In view of the foregoing, in one illustrative embodiment of the present invention, a fixing device for fixing an unfixed toner image on a recording medium includes a rotatable fixing member, a heater, a first pressing member, and a temperature detector. The rotatable fixing member is heated by the heater, and contacts the recording medium bearing the unfixed toner image while rotating. The heater is disposed inside the fixing member and turned on and off intermittently at a start of a fixing process to heat the fixing member intermittently. The first pressing member is disposed opposite the fixing member to press against and rotate the fixing member to define a fixing nip through which the recording medium passes to fix the unfixed toner image with heat and pressure. The temperature detector detects a change in the temperature of the fixing member when the heater turns on and off intermittently. When the temperature detector detects the change in the temperature of the fixing device, the heater is turned on continuously.

In another illustrative embodiment of the present invention, an image forming apparatus includes an image forming unit and a fixing device. The image forming unit forms an unfixed toner image on a recording medium. The fixing device fixes the unfixed toner image on the recording medium. The fixing device includes a rotatable fixing member, a heater, a first pressing member, and a temperature detector. The rotatable fixing member is heated by the heater, and contacts the recording medium bearing the unfixed toner image while rotating. The heater is disposed inside the fixing member and turned on and off intermittently at a start of a fixing process to heat the fixing member intermittently. The first pressing member is disposed opposite the fixing member to press against and rotate the fixing member to define a fixing nip through which the recording medium passes to fix the unfixed toner image with heat and pressure. The temperature detector detects a change in the temperature of the fixing member when the heater turns on and off intermittently. When the temperature detector detects the change in the temperature of the fixing device, the heater is turned on continuously.

Additional features and advantages of the present invention will be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
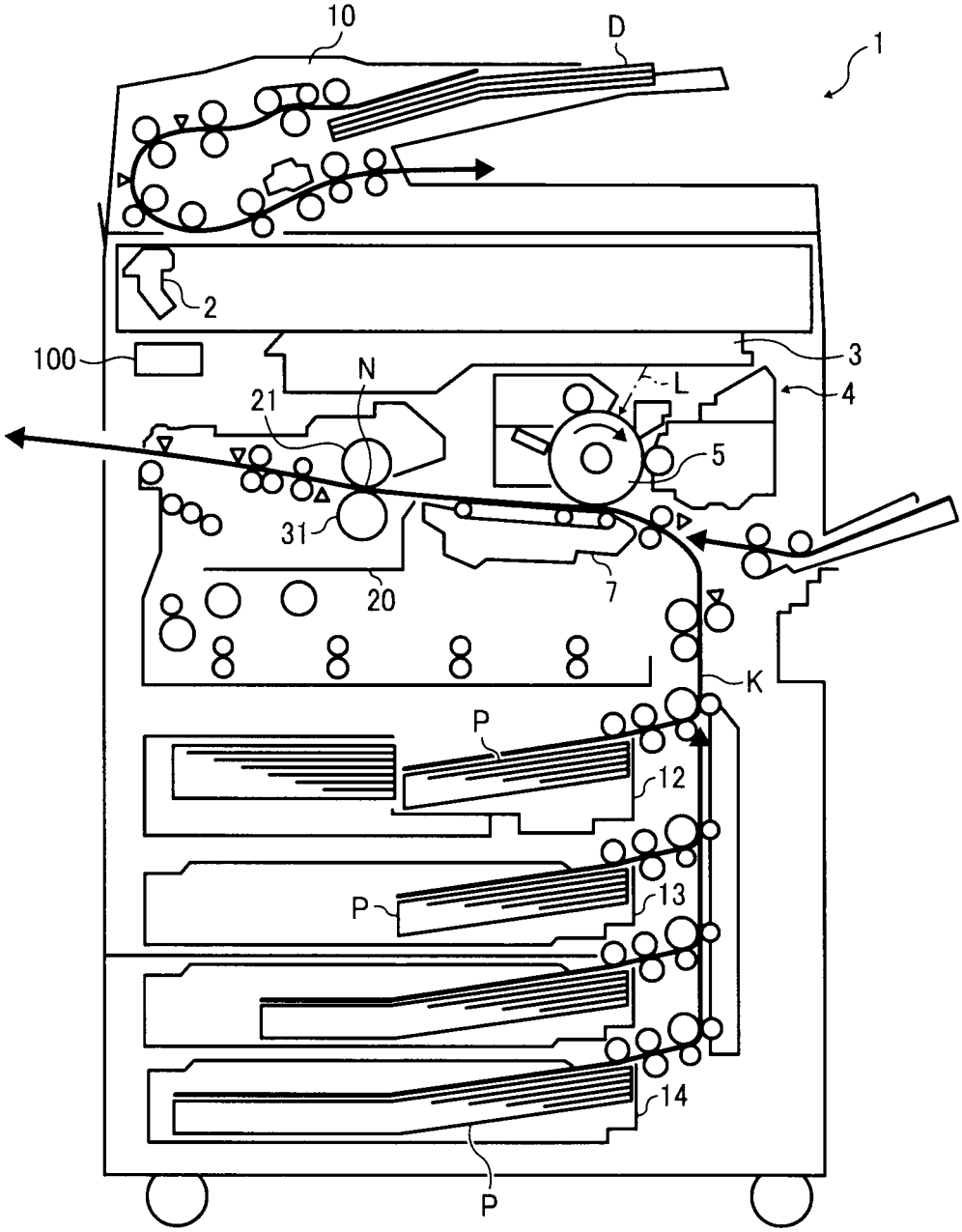
FIG. 1 is a schematic diagram illustrating an image forming apparatus according to an illustrative embodiment of the present invention.

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, and initially to FIG. 1, one example of an image forming apparatus according to a first illustrative embodiment of the present invention is described.

FIG. 1 is a schematic diagram illustrating a copier as one example of the image forming apparatus according to the illustrative embodiment.

In FIG. 1, the image forming apparatus includes a copier main body 1, a document reader 2, an exposure unit 3, an image forming unit 4, a photoreceptor drum 5, a transfer unit 7, a sheet conveyance unit 10, sheet feed cassettes 12, 13, and 14, and a fixing device 20.

The document reader 2 optically reads image information of a document D. The exposure unit 3 illuminates the photoreceptor drum 5 with exposure light L based on the image information read by the document reader 2. The image forming unit 4 includes the photoreceptor drum 5 and forms a toner image on the photoreceptor drum 5. The transfer unit 7 transfers the toner image formed on the photoreceptor drum 5 onto a recording medium P. The sheet conveyance unit 10 conveys the document D to the document reader 2. The sheet feed cassettes 12, 13, and 14 store multiple recording media sheets P. The fixing device 20 fixes an unfixed toner image on the recording medium P. The fixing device 20 includes a tubular fixing film 21 serving as a fixing member and a pressure roller 31 serving as a pressure member.

With reference to FIG. 1, a description is now provided of a normal image forming operation.

The document D placed on a document table is conveyed in a direction of arrow and passes over the document reader 2. As the document D passes over the document reader 2, the image information of the document D is optically read by the document reader 2.

The image information optically read by the document reader 2 is converted to an electronic signal which is then provided to the exposure unit 3 serving also as an optical writing controller. The exposure unit 3 projects the exposure light L against the photoreceptor drum 5 of the image forming unit 4 based on the electronic signal of the image information.

In the image forming unit 4, the photoreceptor drum 5 is rotated in a clockwise direction. An electrostatic latent image on the photoreceptor drum 5 is developed through imaging processing such as charging processing, exposure processing, and developing processing. Accordingly, the toner image is formed on the photoreceptor drum 5 in accordance with the image information.

Subsequently, the toner image formed on the photoreceptor drum 5 is transferred onto the recording medium P being conveyed in the transfer unit 7.

The recording medium P is conveyed in the image forming apparatus as follows. One of the sheet feed cassettes 12, 13, and 14 of the main body 1 is selected automatically or manually. For example, when the sheet feed cassette 12 at the top is selected, the top sheet of the recording media sheets P in the sheet feed cassette 12 is conveyed to a sheet conveyance path K.

Subsequently, the recording medium P passes through the sheet conveyance path K and is conveyed to the transfer unit 7 in appropriate timing such that the recording medium P is aligned with the image formed on the photoreceptor drum 5. As the recording medium P is conveyed to the transfer unit 7, the toner image on the photoreceptor drum 5 is transferred onto the recording medium P.

After the transfer processing, the recording medium P is conveyed to the fixing device 20 after passing through the transfer unit 7. When arriving at the fixing device 20, the recording medium P is sent to a nip portion N serving as a fixing nip where the fixing film 21 and the pressure roller 31 meet and press against each other. In the nip portion N, the toner image is fixed by heat from the fixing film 21 and pressure of the pressure roller 31.

After the toner image is fixed, the recording medium P exits from the nip portion N between the fixing film 21 and the pressure roller 31. Then, the recording medium is discharged outside the main body 1.

Figure 2:
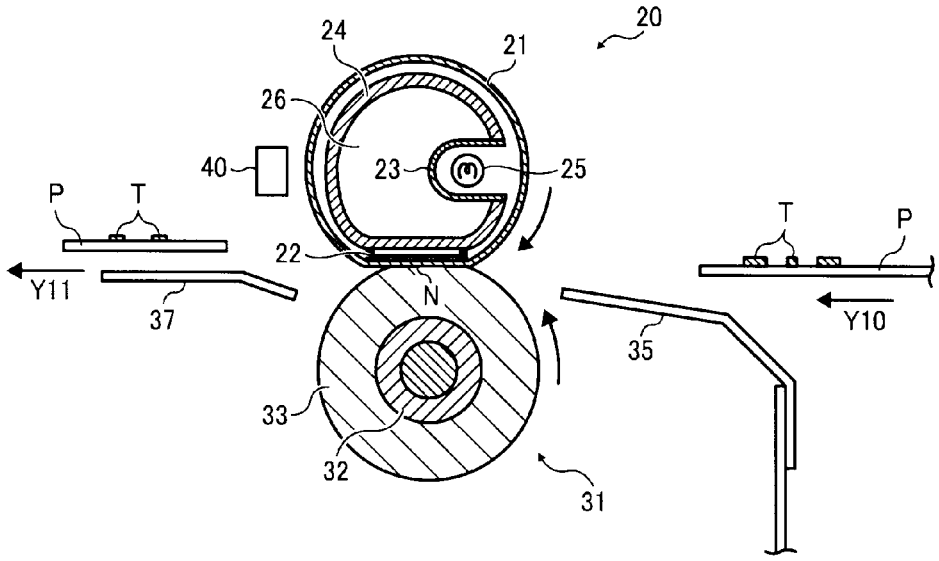
FIG. 2 is a schematic cross-sectional diagram illustrating a fixing device according to an illustrative embodiment of the present invention.
Figure 3:
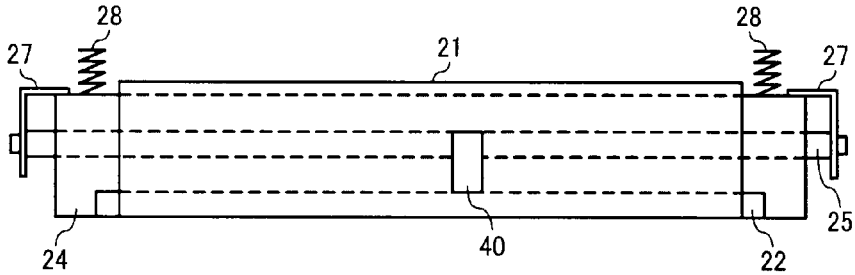
FIG. 3 is a schematic side view of a fixing film serving as the fixing member according to an illustrative embodiment of the present invention.

With reference to FIGS. 2 and 3, a detailed description is provided of the fixing device 20 according to the illustrative embodiment. FIG. 2 is a cross-sectional schematic diagram illustrating the fixing device 20. FIG. 3 is a side schematic view of the fixing film 21 serving as the fixing member.

As illustrated in FIG. 2, the fixing device 20 includes the fixing film 21 serving as the fixing member, a pressure pad 22 serving as a pressure member, a reflection member 23 serving as a reflection member, a holding member 24, a heater 25, the pressure roller 31, guide plates 35 and 37, a temperature detector 40, and so forth.

The holding member 24 is made of heat-resistant resin and holds the fixing film 21. The heater 25 is an infrared heater and serves as a heating member. The guide plates 35 and 37 guide and convey the recording medium P. The first temperature detector 40 serves as a temperature detector that detects a temperature of the surface of the fixing film 21.

The holding member 24 is configured to retain the shape of the fixing film 21. Since the fixing film 21 is made of flexible material and has a substantially circular shape, the holding member 24 has a substantially circular shape in cross section to retain the shape of the fixing film 21 to some extent. With this configuration, deformation of the fixing film 21 can be prevented, thus preventing damage to the fixing film 21.

The pressure roller 31 is rotatably provided to a side plate of the fixing device 20, not illustrated, through a shaft bearing and driven by a drive motor, not illustrated, in a counterclockwise direction indicated by an arrow in FIG. 2. As the pressure roller 31 rotates, the fixing film 21 is rotated due to friction with the pressure roller 31, thereby enabling the fixing film 21 to rotate in the clockwise direction indicated by an arrow in FIG. 2.

The pressure roller 31 includes a metal core 32, the circumference of which is provided with an elastic layer 33. The elastic layer 33 is made of material such as fluoro rubber, silicone rubber, and foam silicone rubber. A thin release layer (tube) made of, for example, perfluoroalkoxy copolymer (PFA) resin, may be provided on the surface of the elastic layer 33.

Inside the fixing film 21, that is, inside the hollow of the fixing film 21, the heater 25, the pressure pad 22, the reflection member 23, the holding member 24, and so forth are disposed. The fixing film 21 is pressed against the pressure roller 31 from the inner circumferential side of the fixing film 21 by the pressure pad 22, thereby forming a nip portion N between the fixing film 21 and the pressure roller 31.

The guide plate 35 that guides the recording medium P to the nip portion N is disposed substantially at the beginning side of the nip portion N. The guide plate 37 that guides the recording medium P being discharged is disposed substantially at the end side of the nip portion N. Both the guide plate 35 and the guide plate 37 are fixed to a frame (housing) of the fixing device 20, not illustrated.

The heater 25 is disposed inside a through-hole 26 provided to the holding member 24. The through-hole 26 is formed along the longitudinal direction of the fixing film 21. The reflection member 23 is fixed to the inner circumference of the through-hole 26.

In FIG. 3, holders 27 are provided to the main body of the fixing device 20 to hold each end of the holding member 24. The fixing device 20 includes an urging member 28 which may be a compression spring or the like that urges the fixing film 21 against the pressure roller 31 through the holding member 24.

An end portion of the heater 25 is detachably fitted in a hole formed in the holder 27, not illustrated.

The fixing film 21 is a thin flexible tubular film that is endless. The fixing film 21 is rotated in the direction of arrow in FIG. 2. The material of the fixing film 21 includes, but is not limited to, polyimide resin, polyamide resin, fluoro resin, and a thin metal plate.

In order to secure good release properties (separability) with respect to toner T or a toner image, a release layer may be provided on the surface of the fixing film 21. Such a release layer may be made of perfluoroalkoxy copolymer resin (PFA), polyimide resin, polyetherimide resin, polyether sulfide (PES) and so forth. Using the fixing film 21 having a low heat capacity as a fixing member allows a significantly short rise time in the on-demand fixing device.

The pressure pad 22 is made of a thin metal plate with a thickness of approximately 0.1 mm. Alternatively, the pressure pad 22 may be a thin plate made of ceramic, polyimide resin, or any other suitable material. The pressure pad 22 and the pressure roller 31 meet and press against each other through the fixing film 21, thereby forming the nip portion N. The pressure pad 22 is fixedly supported by the fixing device 20.

The surface of the pressure pad 22 facing the pressure roller 31 has a substantially flat surface which makes the shape of the nip portion N facing the recording medium P substantially parallel with the image bearing surface of the recording medium P. With this configuration, the fixing film 21 can contact the recording medium P closely, thereby enhancing fixing ability. Furthermore, the recording medium P passing through the nip portion N is prevented from getting curled or creased. Still further, since the curvature of the fixing film 21 at the end side of the nip portion N increases, the recording medium P discharged from the nip portion N is separated easily from the fixing film 21.

According to the illustrative embodiment, the surface of the pressure pad 22 that slidably contacts the fixing film 21 is coated with diamond-like carbon (DLC), thereby reducing abrasion of the inner circumference surface of the fixing film 21 that slidably contacts the pressure pad 22. Alternatively, instead of using the DLC coating, a PFA sheet, which is a sheet woven in a net pattern using PFA fiber, may be disposed between the fixing film 21 and the pressure pad 22.

Figure 4:
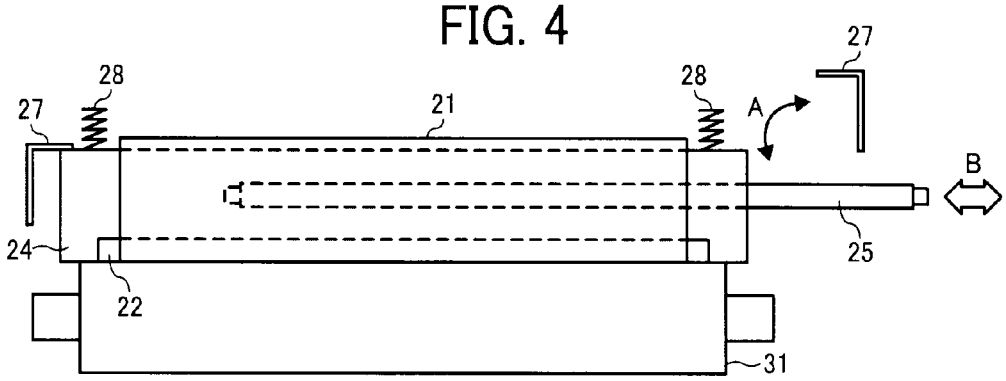
FIG. 4 is a schematic diagram illustrating removal of heaters of the fixing device of FIG. 2.

Referring now to FIG. 4, there is provided a schematic diagram illustrating removal of the heater 25 from the fixing device 20 according to the illustrative embodiment.

The heater 25 consists of a carbon heater or a halogen heater. Both ends of the heater 25 are fixed to the side plates of the fixing device 20 through the holding member 24. The pressure pad 22 is heated by the heater 25 controlled by a power source of the image forming apparatus.

Subsequently, the pressure pad 22 heats the fixing film 21 which then heats the toner image T on the recording medium P.

The output of the heater 25 is controlled based on the temperature of the surface of the fixing film 21 detected by the temperature detector 40 disposed within a sheet passing area opposite the surface of the fixing film 21. A desired temperature of the fixing film 21, that is, the fixing temperature, is obtained by controlling the output of the heater 25 as described above. The control of the heater 25 is implemented by a control section of a processor such as a central processing unit (CPU) 100 employed in the image forming apparatus or the fixing device 20.

According to the illustrative embodiment, as illustrated in FIG. 4, the heater 25 is easily detached from the fixing device 20 while the pressure pad 22 is contacting the pressure roller 31 through the fixing film 21.

When the heater 25 needs to be removed from the fixing device 20, for example, there is a need for maintenance of the heater 25, one of the holders 27 is removed from the holding member 24 by unfastening a screw, not illustrated, that fastens the holder 27 to the holding member 24. The holder 27 is removed from the holding member 24 in the direction indicated by a double-headed arrow A in FIG. 4.

Subsequently, the heater 25 is pulled out from the hole 26 of the holding member 24 in the direction indicated by a double-headed arrow B, that is, the same side from which the holder 27 is removed. A new heater or the heater 25 after maintenance is installed in the fixing device 20 in reverse.

With the configuration described above, the fixing device 20 is enabled to reduce its rise time, and replacement of the heater 25 is easily done with a simple structure as described above. That is, replacement can be performed without releasing pressure of the pressure pad 22 and between the fixing film 21 and the pressure roller 31, requiring no dedicated structure that releases the pressure and thus facilitating replacement and maintenance of the heater 25.

Referring back to FIG. 2, the heater 25 is disposed in the hole 26, spaced from the fixing film 21 and the reflection member 23. In other words, there is a certain gap between the heater 25 and the fixing film 21, as well as the reflection member 23.

This configuration prevents the heater 25 from being directly affected by vibration of the fixing film 21, the reflection member 23, and so forth when transporting the fixing device 20 including the pressure pad 22 contacting the pressure roller 31 through the fixing film 21. Accordingly, the heater 25 is prevented from suffering damage.

Furthermore, even when paper jams occur in the fixing device 20 and the jammed sheet needs to be removed while the pressure pad 22 is in contact with the pressure roller 31 through the fixing film 21, the heater 25 is not directly affected by undesirable physical impact or vibration caused by the fixing film 21 and the reflection member 23, thereby also keeping the heater 25 from damage.

It is to be noted that using a carbon heater as the heater 25 provides greater flexibility in its on-off control compared with a halogen heater. In particular, even when the distribution of power is repeatedly stopped before a duty of the heater 25 reaches 100%, disconnection does not occur and degradation of output over time is thus reduced.

When using the carbon heater, it is preferable to configure the shape of the carbon heater such that an amount of radiant heat in the direction facing the fixing film 21 is greater than an amount of radiant heat in the direction perpendicular to the direction facing the fixing film 21. With this configuration, heat radiated from the heater 25 is directed intensively to the fixing film 21, thereby heating the fixing film 21 efficiently.

The reflection member 23 is disposed such that the opening thereof faces the portion of the fixing film 21 to be heated. In order to transmit as much heat received by the fixing film 21 as possible to the nip portion N before heat dissipates in the atmosphere, it is desirable to heat the portion of the fixing film 21 adjacent to the beginning of the nip portion N relative to the direction of rotation of the fixing film 21.

According to the illustrative embodiment, the base material of the reflection member 23 is glass. The interior of the reflective surface of the reflection member 23 is plated with metal or aluminum is evaporated onto the interior of the reflective surface.

Figure 5:
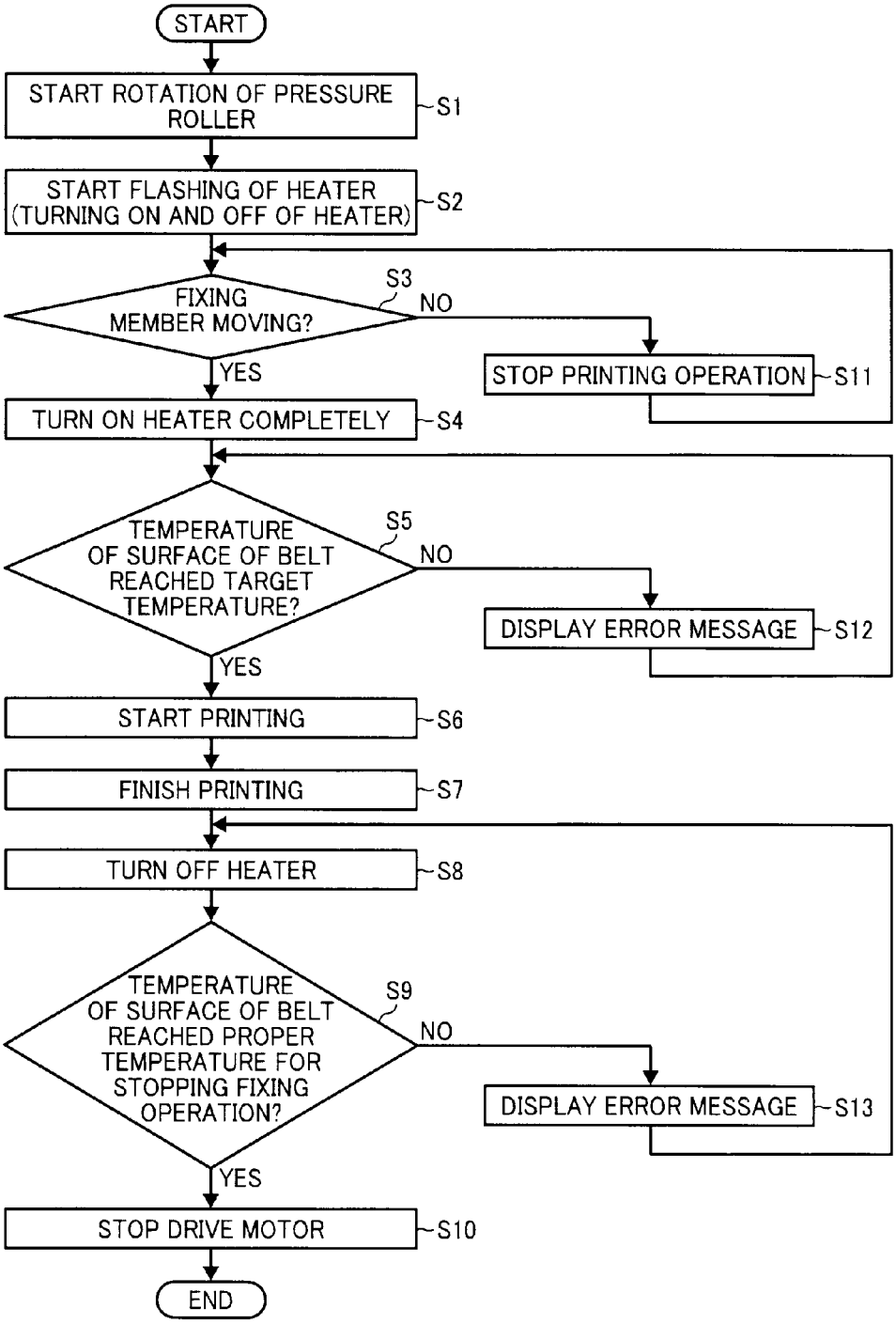
FIG. 5 is a flowchart showing steps in detection of temperature and control of the fixing film according to an illustrative embodiment of the present invention.

With reference to FIG. 5, a description is provided of detection and control of the temperature of the fixing film 21 according to the illustrative embodiment. FIG. 5 is a flowchart showing steps in the temperature control of the fixing film 21.

When the CPU 100 serving as the control unit of the image forming apparatus receives a print-start signal, initially, the CPU 100 sends an ON-signal to the pressure roller 31 drive motor, not illustrated, at step S1. Due to friction with the pressure roller 31, the fixing film 21 is rotated in the direction of the arrow as shown in FIG. 2.

Subsequently, at step S2, the heater 25 is flashed, that is, turned on and off repeatedly, in a certain cycle. At step S3, based on the temperature of the fixing film 21 detected by the temperature detector 40, whether or not the fixing film 21 is rotated or moved is verified in a manner described later. If rotation or movement of the fixing film 21 is confirmed (YES at step S3), the heater 25 is turned on continuously at step S4.

By contrast, if rotation or movement of the fixing film 21 is not confirmed at step S3 (NO at step S3), it is detected as an "error", the process advances to step S11 at which the printing operation is stopped. By this time, the heater 25 has been turned on and off intermittently so that the fixing film 21, which was halted until the "error" is detected, is prevented from getting heated locally and thus damaged or deformed permanently.

When the heater 25 starts to heat the fixing film 21 at step S4, whether or not the temperature of the fixing film 21 has reached an appropriate temperature for initiating the printing operation is determined at step S5. If the temperature of the fixing film 21 has reached the appropriate temperature (YES at step S5), printing is initiated while regulating the temperature of the fixing film 21 at a certain temperature at step S6.

By contrast, if the temperature of the fixing film 21 has not reached the temperature at which printing is initiated within a predetermined time period (NO at step S5), it is detected as an error and an error message is shown on a display member at step S12. Then, the printing operation is turned off.

Upon detecting the error as described above, it is determined that there may be a problem with the temperature detector 40 or the heater 25.

It is to be noted that faulty movement of the fixing film 21 such as slippage or the like can be detected based on the temperature detected by the temperature detector 40 with respect to the fixing film 21. Alternatively, faulty movement of the fixing film 21 can be detected using a known detection method.

When printing is finished at step S7, the heater 25 is turned off at step S8. Subsequently, the temperature detector 40 detects the temperature of the fixing film 21, and whether or not the detected temperature has reached an appropriate temperature for stopping driving of the pressure roller 31 is determined at step S9.

If the detected temperature has reached the temperature for stopping driving of the pressure roller 31 at step S9 (YES at step S9), at step S10 the drive motor that drives the pressure roller 31 is provided with a signal that turns off the drive motor for driving the pressure roller 31, thereby finishing the printing (fixing) operation.

By contrast, if the temperature of the fixing film 21 has not reached the temperature for stopping driving of the pressure roller 31 at step S9 (NO at step S9), there is a possibility that the heater 25 is not turned off. Consequently, it is detected as an error and the error message is shown on the display at step S13. Subsequently, the process returns to step S8 and the subsequent steps are repeated.

According to the illustrative embodiment, when rotation of the fixing film 21 is not confirmed or abnormal rotation is detected, either case is detected as an error and appropriate processes are carried out as described above. With this configuration, the fixing film 21 is prevented from getting continuously and excessively heated by the heater 25.

The foregoing description pertains to a fixing device using a heating roller or a fixing film externally heated. However, the present invention is equally applicable to a fixing device using a fixing film that is wound around and looped between a pair of rollers. In such a configuration, the fixing film is also prevented from getting overheated.

Furthermore, the present invention is also applicable to and effective for a fixing device using a carbon heater to heat the fixing member promptly.

A description is now given of an example of a method of determining the drive state of the film from the film temperature conducted in step S3 described above.

Figure 6:
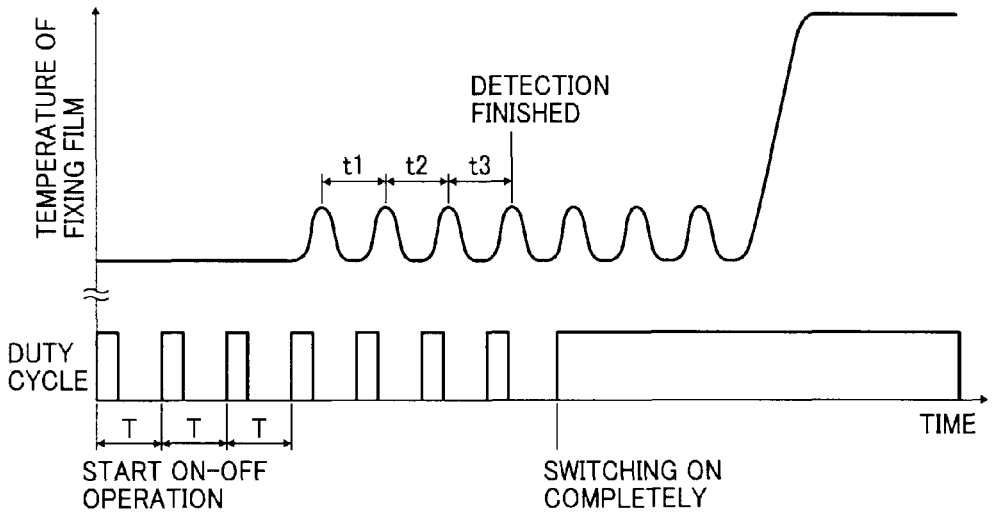
FIG. 6 is a chart schematically illustrating a relation between a duty cycle of a heater and a temperature of the fixing film according to an illustrative embodiment of the present invention.

Referring now to FIG. 6, there is provided a chart illustrating a relation between a duty cycle of the heater 25 and the temperature of the fixing film 21 at the time of start of the fixing operation.

At the start of fixing operation, initially, power is supplied intermittently to the heater 25 at a period of T, turning on and off the heater 25. As illustrated in FIG. 2, the heater 25 heats the fixing film 21 locally, causing the temperature of the surface of the fixing film 21 to change periodically. In other words, a temperature distribution is generated.

Changes in the temperature are detected by the temperature detector 40 multiple times (detected as temperature cycles t1, t2, t3, and so forth) as a peak-to-peak cycle. Confirming that this cycle coincides with the duty cycle of the heater 25, the heater 25 is turned on continuously in preparation for the fixing operation.

With this method, even when the fixing film 21 is not properly rotated or moved, the fixing film 21 is prevented from getting overheated and thus damaged before the temperature detector 40 detects that the fixing film 21 is not rotated or moved. This is because the heater 25 is turned on and off intermittently before the heater 25 is turned on continuously.

Figure 7:
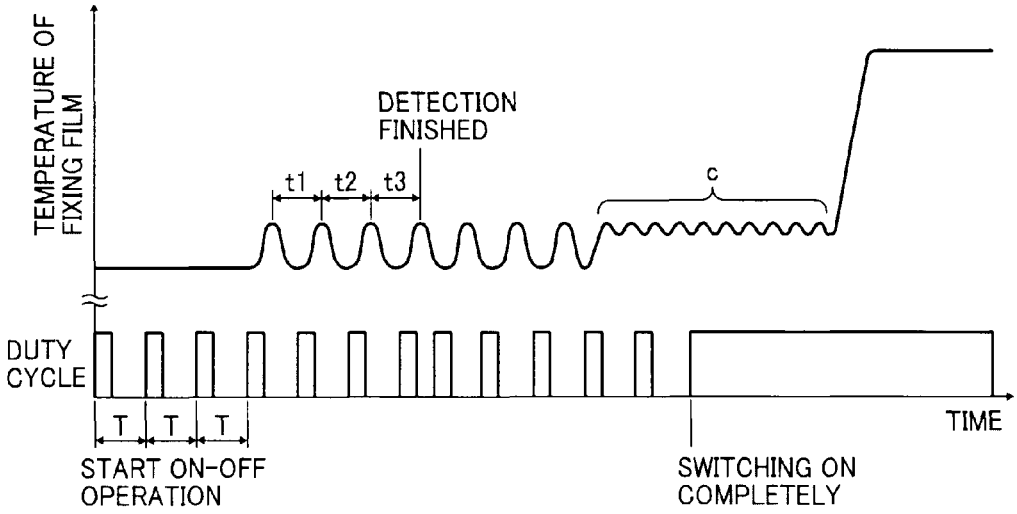
FIG. 7 is a chart schematically illustrating a relation between the duty cycle of the heater and the temperature of the fixing film when the fixing film is heated supplementarily by the heater after detection of rotation of the fixing film according to an illustrative embodiment of the present invention.

Referring now to FIG. 7, there is provided a chart schematically illustrating a relation between the duty cycle of the heater 25 and the temperature of the fixing film 21 when the fixing film 21 is heated supplementarily by the heater 25 after detection of rotation of the fixing film 21.

As illustrated in FIG. 7, in order to heat a portion of the fixing film 21 having not been heated during the intermittent heating operation at the start of the fixing operation, the heater 25 is turned on and off supplementarily for a certain duration as indicated by a reference letter "c" in FIG. 7 after rotation of the fixing film 21 is detected in the same or similar manner as described above with reference to FIG. 6. With such an operation, the surface of the fixing film 21 is heated more evenly. Subsequently, the heater 25 is turned on continuously to heat the fixing film 21 evenly to achieve a target temperature for fixing the toner image, preventing irregular fixation.

Figure 8:
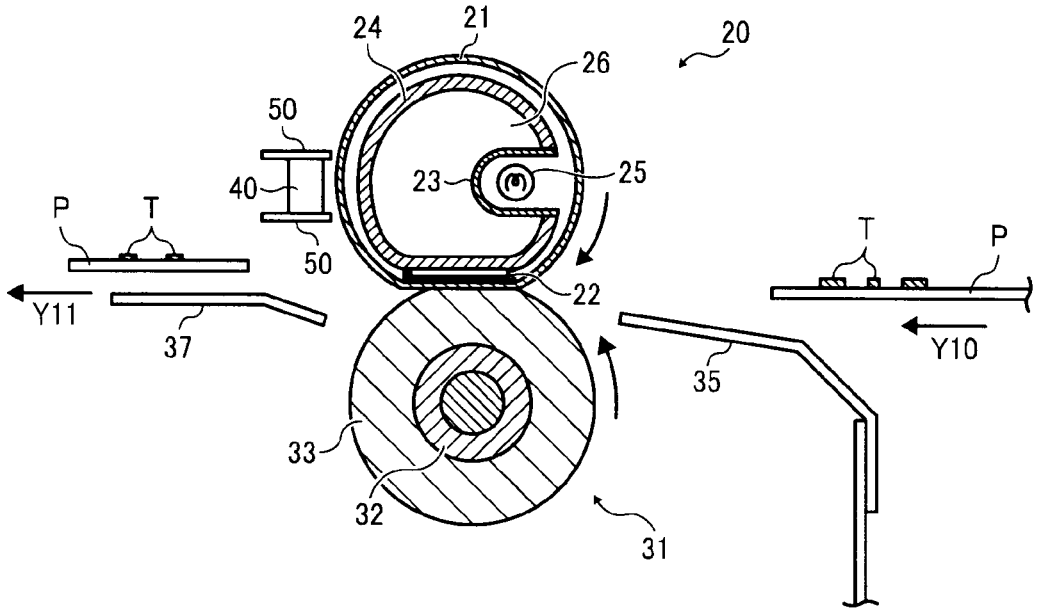
FIG. 8 is a cross-sectional schematic view illustrating a variation of the fixing device according to an illustrative embodiment of the present invention.

It is to be noted that changes in the temperature of the surface of the fixing film 21 need to be detected with precision. For precise detection, the temperature detector 40 may be covered by a heat insulating member 50 as illustrated in FIG. 8. FIG. 8 is a cross-sectional schematic view illustrating a variation of the present embodiment.

Figure 9:
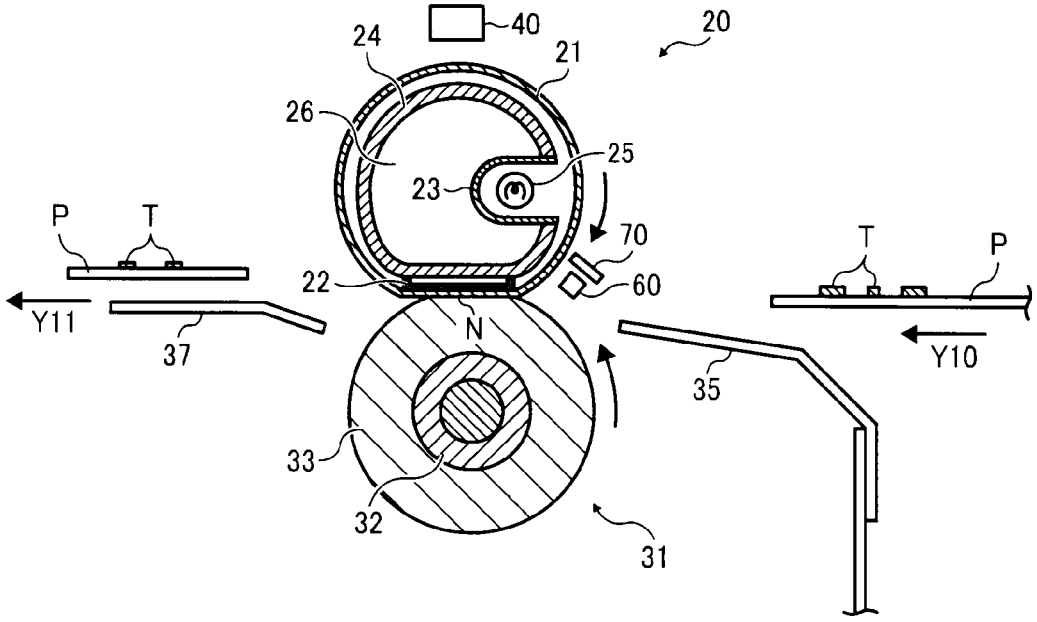
FIG. 9 is a cross-sectional schematic view illustrating another variation of the fixing device according to an illustrative embodiment of the present invention.

According to the illustrative embodiment described above, the temperature detector 40 is disposed substantially downstream of the nip portion N in the direction of rotation of the fixing film 21. However, the position of the temperature detector is not limited to this, and alternatively the temperature detector may be disposed at other places. For example, as illustrated in FIG. 9, in addition to the temperature detector 40, a second temperature detector 60 for detecting rotation of the fixing film 21 may be provided. In this case, it is desirable to provide the temperature detector 60 substantially between the nip portion N and the heater 25, because changes in the temperature of the fixing film 21 are significant therebetween. Providing the temperature detector 60 between the nip portion N and the heater 25 can reduce a time required for the detection.

A heat insulating member 70 may be provided substantially between the temperature detector 60 and the heater 25 to prevent the temperature detector 60 from undesirably detecting the temperature of heat dissipated from the heater 25 and the heated fixing film 21 while the fixing film 21 is not rotating or moving. The insulator 70 can prevent the temperature detector 60 from detecting the temperature of dissipated heat, thereby enhancing detection accuracy.

The foregoing description pertains to a fixing device using a pressure roller serving as a pressure member. However, the pressure member is not limited to a roller. The present invention may apply equally to a fixing device that employs a belt-type pressure member or a pad-type pressure member. In such cases, the same effect as that of the illustrative embodiments can be achieved as well.

Furthermore, according to the illustrative embodiments, the present invention is applicable to the fixing device for fixing an unfixed image, also known as a toner image. The present invention can be employed in the fixing device employed in image forming apparatuses including, but not limited to, a copier, a printer, a facsimile machine, and a multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. A fixing device for fixing an unfixed toner image on a recording medium, comprising:

a rotatable fixing member that is locally heated by a heater to produce a temperature distribution that includes areas across the fixing member in a direction of rotation of periodically changing temperature, and which contacts the recording medium bearing the unfixed toner image while rotating;

the heater disposed inside the fixing member and turned on and off intermittently at a start of a fixing process to heat the fixing member intermittently;

a first pressing member disposed opposite the fixing member to press against and rotate the fixing member to define a fixing nip through which the recording medium passes to fix the unfixed toner image with heat and pressure; and a temperature detector to detect the temperature distribution of the fixing member associated with an output control of the heater, the temperature detector being configured to actively detect whether or not the fixing member is rotated or moved by detecting the temperature distribution of the fixing member at a position on the fixing member within a passing area of the recording medium, wherein, when the temperature detector detects the temperature distribution of the fixing member associated with the output control that includes turning on and off the heater intermittently over a time period from a first time to a second time after the first time, the temperature detector detects over the time period whether or not the fixing member is rotated or moved.

2. The fixing device according to claim 1, wherein the temperature distribution of the fixing device is cyclic.

3. The fixing device according to claim 1, wherein, after the temperature detector detects the temperature distribution, the heater is turned on and off intermittently until the temperature distribution across the fixing member becomes uniform, after which the heater is turned on continuously.

4. The fixing device according to claim 1, further comprising a heat insulating member provided between the temperature detector and the heater.

5. The fixing device according to claim 1, wherein the fixing member is formed of a substantially cylindrical hollow film member.

6. The fixing device according to claim 5, wherein the film member includes one of polyimide resin, polyamide resin, fluoro resin, and a thin metal plate.

7. The fixing device according to claim 1, wherein the fixing member includes a second pressing member disposed inside thereof to press and contact the fixing member against the first pressing member.

8. The fixing device according to claim 1, wherein the heater is configured to be turned on continuously when the first pressing member and the fixing member rotate without slippage between each other.

9. The fixing device according to claim 1, further comprising a second temperature detector disposed opposite an outer surface of the fixing member between the heater and a nip portion of the fixing member and the pressing member.

10. The fixing device according to claim 9, wherein the second temperature detector is a contact-free temperature detector.

11. The fixing device according to claim 1, wherein the heater is a carbon heater configured to radiate a greater amount of heat in a direction facing the fixing member than an amount of heat radiated by the carbon heater in a direction perpendicular to the direction facing the fixing member.

12. The fixing device according to claim 1, wherein the temperature detector is configured to detect a temperature of the fixing member multiple times as a peak-to-peak cycle that coincides with a duty cycle of the heater.

13. The fixing device according to claim 1, wherein the temperature detector is a contact-free temperature detector.

14. The fixing device according to claim 1, wherein the temperature detector detects whether or not the fixing member is rotated or moved before execution of a print job.

15. The image forming apparatus according to claim 1, wherein the temperature detector detects whether or not the fixing member is rotated or moved before the temperature detector detects whether or not the temperature of the fixing member has reached a target temperature for execution of a print job.

16. The image forming apparatus according to claim 1, wherein the temperature detector detects whether or not the fixing member is rotated or moved during a normal state of rotation of the fixing member.

17. An image forming apparatus, comprising:

an image forming unit to form an unfixed toner image on a recording medium; and a fixing device to fix the unfixed toner image on the recording medium, the fixing device including:

a rotatable fixing member that is locally heated by a heater to produce a temperature distribution that includes areas across the fixing member in a direction of rotation of periodically changing temperature, and which contacts the recording medium bearing the unfixed toner image while rotating, the heater disposed inside the fixing member and turned on and off intermittently at a start of a fixing process to heat the fixing member intermittently, a first pressing member disposed opposite the fixing member to press against and rotate the fixing member to define a fixing nip through which the recording medium passes to fix the unfixed toner image with heat and pressure, and a temperature detector to detect the temperature distribution of the fixing member associated with an output control of the heater, the temperature detector being configured to actively detect whether or not the fixing member is rotated or moved by detecting the temperature distribution of the fixing member at a position on the fixing member within a passing area of the recording medium, wherein, when the temperature detector detects the temperature distribution of the fixing member associated with the output control that includes turning on and off the heater intermittently over a time period from a first time to a second time after the first time, the temperature detector detects over the time period whether or not the fixing member is rotated or moved.

18. The image forming apparatus according to claim 17, wherein the heater is configured to be turned on continuously when the first pressing member and the fixing member rotate without slippage between each other.

19. The image forming apparatus according to claim 17, further comprising a second temperature detector disposed opposite an outer surface of the fixing member between the heater and a nip portion of the fixing member and the pressing member.

20. The image forming apparatus according to claim 17, wherein the heater is a carbon heater configured to radiate a greater amount of heat in a direction facing the fixing member than an amount of heat radiated by the carbon heater in a direction perpendicular to the direction facing the fixing member.

21. The image forming apparatus according to claim 17, wherein the temperature detector is configured to detect a temperature of the fixing member multiple times as a peak-to-peak cycle that coincides with a duty cycle of the heater.

22. A method for detection in a fixing device that fixes an unfixed toner image on a recording medium, comprising:

heating a rotatable fixing member by a heater to produce a temperature distribution that includes areas across the fixing member in a direction of rotation of periodically changing temperature, the fixing member contacting the recording medium bearing the unfixed toner image while rotating, the heater being disposed inside the fixing member off an axial center of the fixing member and turned on and off intermittently at a start of a fixing process to heat the fixing member intermittently, and a first pressing member being disposed opposite the fixing member to press against and rotate the fixing member to define a fixing nip through which the recording medium passes to fix the unfixed toner image with heat and pressure;

detecting, by a temperature detector, the temperature distribution of the fixing member associated with an output control of the heater; and actively detecting, by the temperature detector, whether or not the fixing member is rotated or moved by detecting the temperature distribution of the fixing member at a position on the fixing member within a passing area of the recording medium, wherein the detecting includes detecting the temperature distribution of the fixing member associated with the output control that includes turning on and off the heater intermittently over a time period from a first time to a second time after the first time, such that rotation of the fixing member is detected by checking whether or not the temperature distribution detected coincides with a corresponding assumed temperature distribution.

23. An image forming apparatus, comprising:

an image forming unit to form an unfixed toner image on a recording medium; and a fixing device to fix the unfixed toner image on the recording medium, the fixing device including:

a rotatable fixing member that is locally heated by a heater to produce a temperature distribution that includes areas across the fixing member in a direction of rotation of periodically changing temperature, and which contacts the recording medium bearing the unfixed toner image while rotating, the heater disposed inside the fixing member and turned on and off intermittently at a start of a fixing process to heat the fixing member intermittently, a first pressing member disposed opposite the fixing member to press against and rotate the fixing member to define a fixing nip through which the recording medium passes to fix the unfixed toner image with heat and pressure, a temperature detector to detect the temperature distribution of the fixing member associated with an output control of the heater, and a controller configured to actively detect whether or not the fixing member is rotated or moved based on the temperature distribution of the fixing member detected at a position on the fixing member within a passing area of the recording medium, wherein, when the temperature detector detects the temperature distribution of the fixing member associated with the output control that includes turning on and off the heater intermittently over a time period from a first time to a second time after the first time, the controller detects over the time period whether or not the fixing member is rotated or moved.

* * * * *